US005880625A

United States Patent [19]

Park et al.

[11] Patent Number: 5,880,625

[45] Date of Patent: Mar. 9, 1999

[54] TEMPERATURE INSENSITIVE CONSTANT CURRENT GENERATOR

[75] Inventors: Hong-June Park, Pohang; Cheol-Hee Lee, Cheongiu, both of Rep. of Korea

[73] Assignee: Postech Foundation, Kyoungsangbuk-Do, Rep. of Korea

[21] Appl. No.: 891,154

[22] Filed: Jul. 10, 1997

[30] Foreign Application Priority Data

Jul. 10, 1996 [KR] Rep. of Korea ..... 96-27729

[51] Int. Cl.[6] ..... G05F 3/02

[52] U.S. Cl. ..... 327/543; 327/347; 327/538; 327/513; 323/315

[58] Field of Search ..... 327/347, 538, 327/543, 540, 513; 323/312, 315

[56] References Cited

U.S. PATENT DOCUMENTS 4,334,186 6/1982 Sasayama et al. ..... 323/365

5,631,600 5/1997 Akioka et al. ..... 327/543

5,798,637 8/1998 Kim et al. ..... 323/313

*Primary Examiner*—Terry D. Cunningham

*Attorney, Agent, or Firm*—Pennie & Edmonds LLP

[57] ABSTRACT

A temperature compensatory constant current generator comprises a temperature inversely proportional constant current generator for supplying a temperature inversely proportional current, a temperature proportional constant current generator for supplying a temperature proportional current, a temperature inversely proportional current supplier for outputting the temperature inversely proportional current from the temperature inversely proportional constant current generator, a temperature proportional current supplier for outputting the temperature proportional current from the temperature proportional constant current generator and a square root generator for providing a current proportional to multiplied square roots of the temperature inversely proportional current and the temperature proportional current.

12 Claims, 5 Drawing Sheets

TEMPERATURE INSENSITIVE CONSTANT CURRENT GENERATOR

FIELD OF THE INVENTION

The invention relates to a constant current generator; and, more particularly, a CMOS(Complementary Metal-Oxide-Semiconductor)-employing constant current generator generating a constant current regardless of temperature in an effective manner.

DESCRIPTION OF THE PRIOR ART

Referring to FIG. 1, there is illustrated a conventional constant current generator using bipolar transistors.

Transistors Q1 to Q4 included in the constant current generator depicted in FIG. 1 are P-well CMOS substrate NPN bipolar transistors, and the transistors Q1 and Q3 operate as PN diodes collectors and bases being connected to each other.

MOS-employing transistors M5 to M8 constituting a current mirror circuit have an identical ratio of channel width and length.

Since the transistors M1 and M2 operate in saturated region, their current-voltage characteristics satisfy the following equation Eq (1):

$$I = \frac{\mu Cox(W/L)}{2}(Vgs - Vtp)^2, \quad \text{Eq (1)}$$

wherein $\mu$ represents carrier mobility; Cox is the thickness of oxidated layer on the gate; W is the channel width; L is the channel length; Vgs is the voltage between the gate and the source; and Vtp is a threshold voltage of PMOS.

Meanwhile, the voltage drops $V_{BE}$ across the base and the emitter of the transistors Q2 and Q4 are expressed as Eq.(2):

$$V_{BE} = nU_T \ln(I/I_S) \quad \text{Eq (2)}$$

wherein n is the slop factor having a small value; $U_T$ is a thermal voltage represented as kT/q; and $I_s$ is the saturation current of the bipolar transistor.

In the circuit, since the voltage differences between the gate-sources of MOS transistors M1 and M2 are identical to those between the base-emitters of the transistors Q2 and Q4, respectively, the current I1 can be represented as Eq.(3), II being a source current for the transistor M1:

$$I1 = \frac{\mu_p Cox\,(W/L)_2\,(nU_T \ln(10))^2}{2\left(1 - \sqrt{\frac{(W/L)_1}{(W/L)_2}}\right)^2}, \quad \text{Eq (3)}$$

wherein $\mu_p$ is the mobility of PMOS transistor and the natural logarithmic argument value 10 is resulted from the fact that the emitter of the transistor Q4 being 10 times larger than that of the transistor Q1, $(W/L)_i$ represents a ratio of W/L for the transistor Mi. Supposing the output resistance of the MOS transistors to be unlimited, currents I1 and I2 are identical to each other, I2 being a source current for the transistor M2.

As seen in the Eq.(3), since $U_T$ equals to kT/q and $\mu_p$ is known to be proportional to $T^{-1.5}$, the current I1 ends up being proportional to $T^{0.5}$.

Referring to FIG. 2, there is illustrated a constant current generator using MOS transistors.

When all of the MOS transistors M21 to M24 in FIG. 2 operate in saturated regions, the gate voltage differences of the transistors M21 and M22 correspond to a variable voltage ΔV and the current I1 can be represented as Eq. (4):

$$I = \frac{\mu Cox\,(W/L)_1\,(\Delta V)^2}{2\left(1 - \sqrt{\frac{(W/L)_1\,(W/L)_4}{(W/L)_2\,(W/L)_3}}\right)^2}, \quad \text{Eq (4)}$$

wherein ΔV, proportional to the thermal voltage $U_T$, is the voltage generated from the combination circuit of MOS transistors operating at the threshold voltage. In this circuit, although any undesirable effect of the known substrate bias on the threshold can be reduced by combining the sources of the transistors M21 and M22 at a same node, there is disadvantage that the current I becomes proportional to $T^{0.5}$.

SUMMARY OF THE INVENTION

It is, therefore, a primary object of the present invention to provide a constant current generator which is capable of effectively providing a current which is not affected by any change in temperature.

In accordance with the present invention, there is provided a temperature compensatory constant current generator comprising: a temperature inversely proportional constant current generator for supplying a temperature inversely proportional current; a temperature proportional constant current generator for supplying a temperature proportional current; a temperature inversely proportional current supplier for outputting the temperature inversely proportional current from the temperature inversely proportional constant current generator; a temperature proportional current supplier for outputting the temperature proportional current from the temperature proportional constant current generator; and a square root generator for providing a current proportional to multiplied square roots of the temperature inversely proportional current and the temperature proportional current.

BRIEF DESCRIPTION OF THE DRAWINGS

The above and other objects and features of the present invention will become apparent from the following description of the preferred embodiments, when given in conjunction with the accompanying drawings, wherein.

DETAILED DESCRIPTION OF THE PREFERRED EMBODIMENTS

Figure 1:
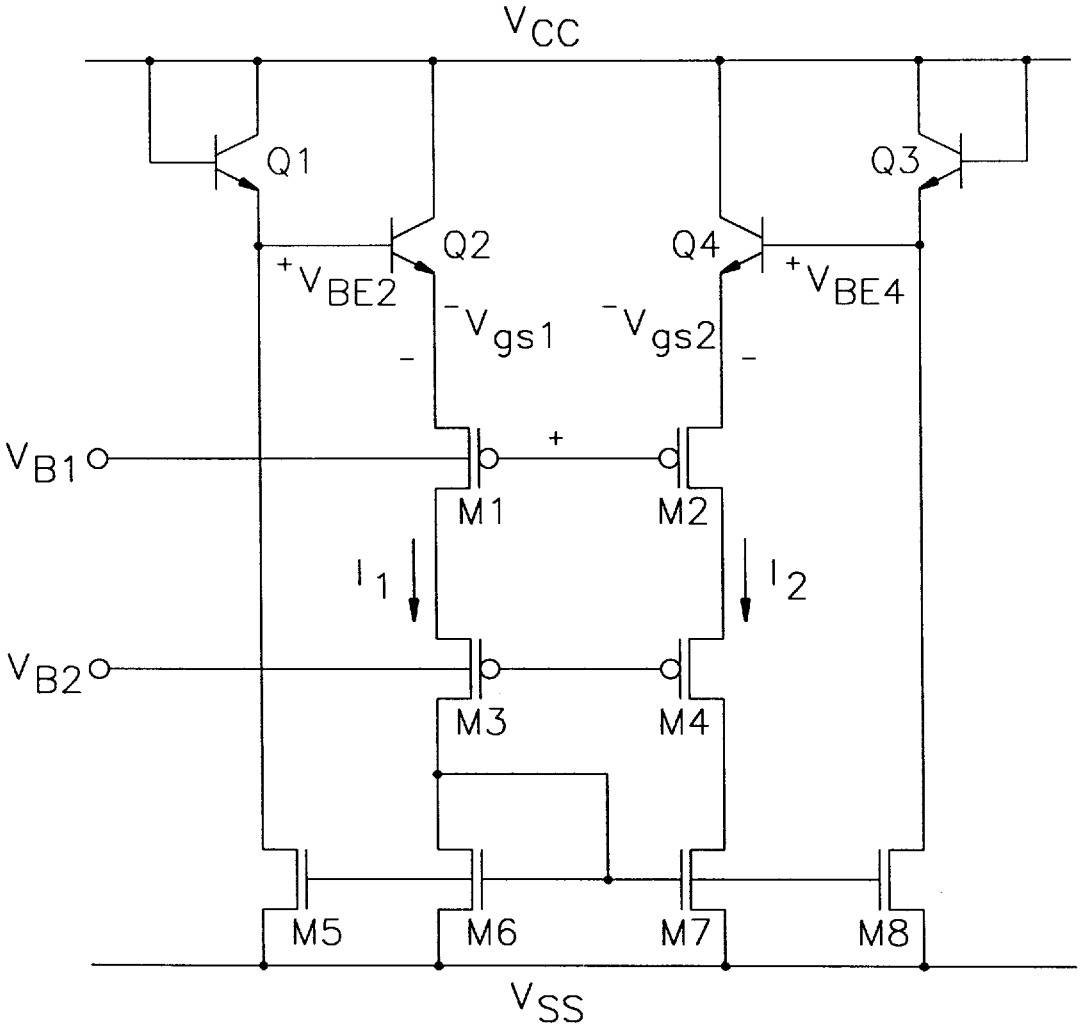
FIG. 1 (PRIOR ART)
FIG. 1 illustrates a conventional constant current generator using bipolar transistors.
Figure 2:
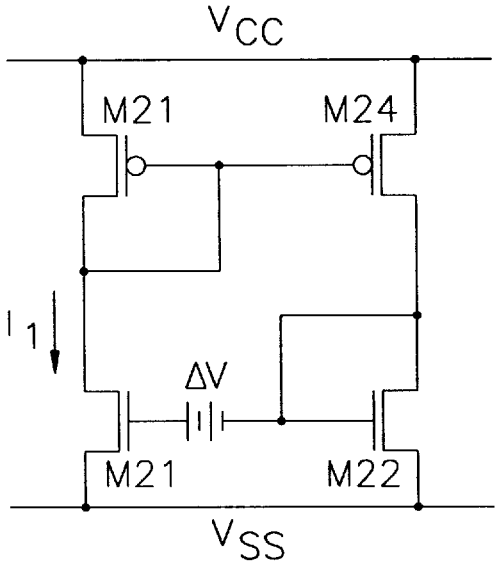
FIG. 2 (PRIOR ART)
FIG. 2 shows a conventional constant current generator using MOS transistors.
Figure 3:
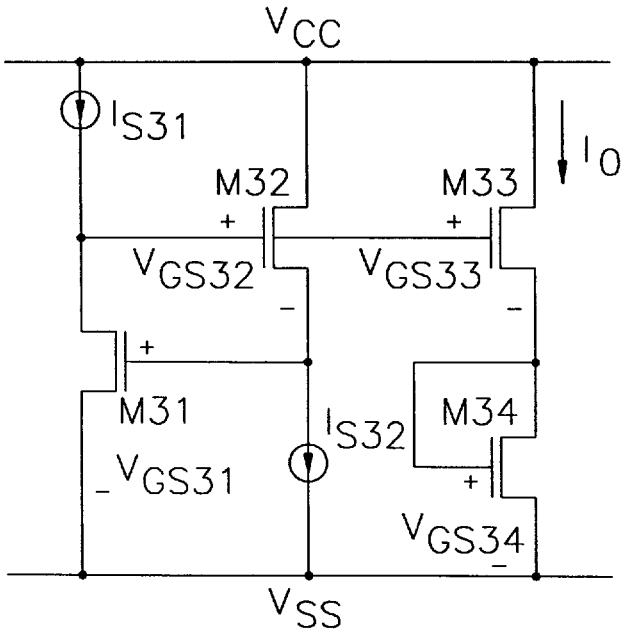
FIG. 3 depicts a schematic conceptual circuit diagram of a temperature compensatory constant current generator in accordance with the present invention.

Referring to FIG. 3, there is depicted a schematic conceptual circuit diagram of a temperature compensatory constant current generator in accordance with the present invention, wherein a current source Is31 is connected to the gates of transistors M32 and M33 and the drain of a transistor M31.

Also, the source of the transistor M32 and the gate of the transistor M31 are both connected to a current source Is32, and the source of a transistor M33 is coupled to a transistor M34 operating as a diode. The transistors M31 to M34 are designed to operate when the gate voltages are in weak inversion region and thus the drain current Id can be represented as Eq.(5):

$$Id = Is\frac{W}{L}\,e^{-\frac{V_{GS}-V_{tP}}{nU_T}}, \qquad \text{Eq (5)}$$

wherein Is is the drain current when $V_{GS}$ equals to $V_{tP}$, $V_{tP}$ being a predetermined threshold voltage.

As illustrated in FIG. 3, the voltage sum of the gate-sources of the transistors M31 and M32 is identical to the voltage sum of the gate-sources of the transistors M33 and M34 (that is, $V_{GS31}+V_{GS32}=V_{GS33}+V_{GS34}$). A current source Is32 is represented by Eq.(4) and the output current Io can be obtained by Eq.(6):

$$I_o = \sqrt{\frac{(W/L)_{33}\,(W/L)_{34}}{(W/L)_{31}\,(W/L)_{32}}}\;\sqrt{Is31}\;\sqrt{Is32}\,. \qquad \text{Eq (6)}$$

As can be seen from Eq.(6), the output current Io of the constant current generator of FIG. 3 is proportional to the square roots of the current sources Is31 and Is32, wherein the current source Is31 is inversely proportional to temperature T and the current source Is21 is proportional to a temperature T.

Figure 4:
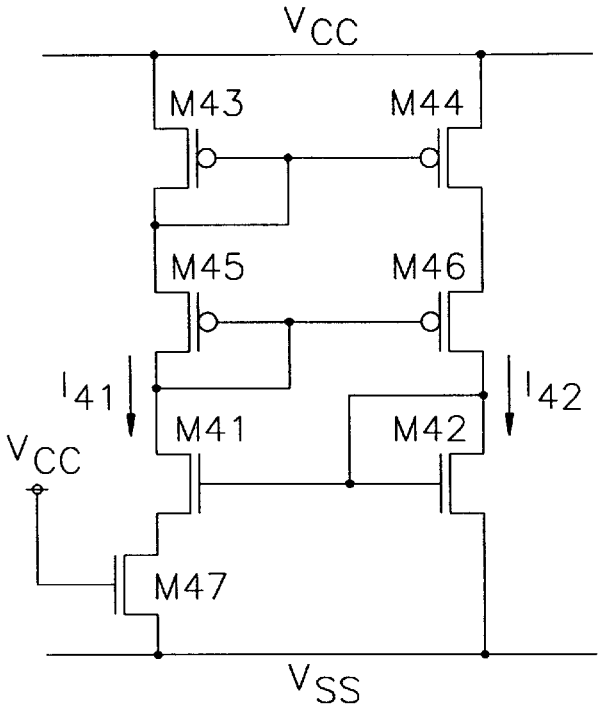
FIG. 4 demonstrates a circuit diagram of the current source shown in FIG. 3.

In FIG. 4, there is represented a circuit diagram of the current source Is31 shown in FIG. 3.

Transistors M41 and M42, M43 and M44, M45 and M46 are connected to each other, respectively, by forming current mirror circuits, and all of these transistors operate in saturated regions. The transistor M41 is coupled to a transistor M47, which operate in a linear region.

Meanwhile, the two current mirror circuits formed by the transistors M43 and M44, M45 and M46, respectively, are coupled to each other in a cascode fashion to thereby reduce current fluctuation due to channel length modulation effects of the transistors.

Bias of the circuit in FIG. 4 is determined by the self bias circuit which is formed by a positive feedback loop obtained by using current mirror circuits of the transistors M41 to M44. The drain-source voltage difference of the transistor M47 given by Eq.(8) becomes equal to the gate-source voltage difference of the transistors M41 and M42, being expressed in Eq.(7):

$$Vgs_{42} - Vgs_{41} = \sqrt{\frac{2I_{42}}{\beta_{42}}}\left(1-\frac{\sqrt{(W/L)_{42}\,(W/L)_{43}}}{(W/L)_{41}\,(W/L)_{44}}\right). \qquad \text{Eq (7)}$$

$$Vds_{47} = \frac{I_{41}}{\beta_{47}\,(VGs_{47}-Vth)} = \frac{I_{41}}{\beta_{47}\,(Vcc_{47}-Vth)}\,. \qquad \text{Eq (8)}$$

wherein β is a parameter as represented by $\mu$Cox(W/L).

The W/L ratios of the transistors M44 and M43 are identical to each other and the mirror circuit currents I41 and I42 are same. By equating the Eqs. (7) and (8), an equation for the current I41 is obtained as follows:

$$I_{41} = 2\mu_N Cox\frac{((W/L)_{47})^2}{(W/L)_{42}}\left(1-\sqrt{\frac{(W/L)_{42}}{(W/L)_{41}}}\right)^2(Vcc_{47}-Vth)^2, \qquad \text{Eq (9)}$$

wherein $\mu_N$ represents mobility of N-channel MOSFET. As can be seen from Eq.(8), the current I41 is proportional to the mobility $\mu_N$. Since mobility of N-channel MOSFET is proportional to the −(1.5)th power of temperature, that is to, $T^{-1.5}$, the currents I41 and I42 in FIG. 4 is inversely proportional to the change in the temperature.

Figure 5:
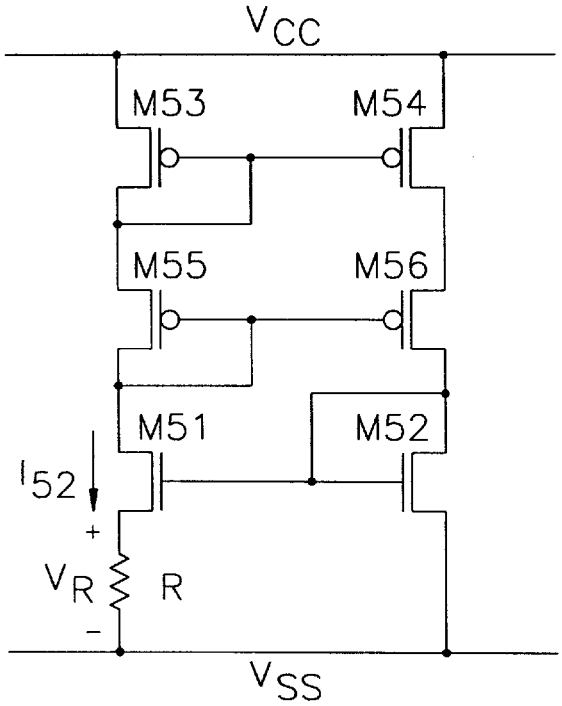
FIG. 5 shows a circuit diagram of the other current source shown in FIG. 3.

Referring to FIG. 5, the circuit of the current source Is32 shown in FIG. 3 is illustrated.

As can be seen from FIG. 5, pairs of transistors M51 and M52, M53 and M54, form respective current mirror circuits, and all of them operate in saturated regions. To the transistor M51 a bias resistor R is coupled. The two current mirror circuits formed by the pairs of the transistors M53 and M54, M55 and M56, respectively, are coupled to each other in a cascode fashion to thereby reduce current fluctuation due to channel length modulation effects of the transistors. Bias of the circuit in FIG. 5 is determined by the self bias circuit which is formed by a positive feed back loop obtained by using current mirror circuits of the transistors M51 to M54.

In the circuit, the voltage drop across the resistor R is equal to the gate-source voltage drop of the transistor M51, which is equal to the gate-source voltage drop of the transistor M52, which is expressed as Eq.(10):

$$Vgs_R = \sqrt{\frac{2I_{52}}{\beta_{52}}}\left(1-\frac{\sqrt{(W/L)_{52}\,(W/L)_{53}}}{(W/L)_{51}\,(W/L)_{54}}\right). \qquad \text{Eq (10)}$$

Since $$V_R = T_{52}R \qquad \text{Eq (11),}$$

by simplifying the equations Eq.(10), Eq (11) is obtained as follows:

$$I_{52} = \frac{\left(1-\frac{(W/L)_{52}}{(W/L)_{51}}\right)^2}{R^2\mu_N Cox\,(W/L)_{52}}\,. \qquad \text{Eq (12)}$$

Thus, being inversely proportional to the mobility $\mu_N$, the current I52 is proportional to a change in the temperature.

Since the currents I41 and I52 are inversely proportional and proportional to temperature, respectively, the output current Io is proportional to combinations of (Vcc-Vth)/R and the W/L ratios of the transistors. As described above, in the output current Io, the mobility and the effects due to the temperature change cancel out each other and only the temperature dependent factors of the resistor R and the threshold voltage Vth remain. Generally, resistors used in integrated circuits are e.g., poly resistors and diffusion resistors having temperature dependence as high as several hundreds to several thousands ppm/° C. On the other hand, the temperature dependence of the threshold voltage is −1 to 2 mV/° C. Consequently, the temperature dependence of the resistor R and the threshold voltage Vth can cancel out each other.

To summarize, the primary temperature dependence of the output current Io is eliminated by the squared root circuits described above, the mobility and the effects due to temperature change cancelling out each other. And the secondary temperature dependence of the output current Io is abolished by the interaction of temperature dependence of the register R and the threshold voltage Vth as described above.

Since the temperature dependence of the register R and the threshold voltage Vth do not cancel out each other completely, the current Io can change slightly according as the temperature changes. Nevertheless, this can be adjusted by adapting supply voltage Vcc.

Figure 6:
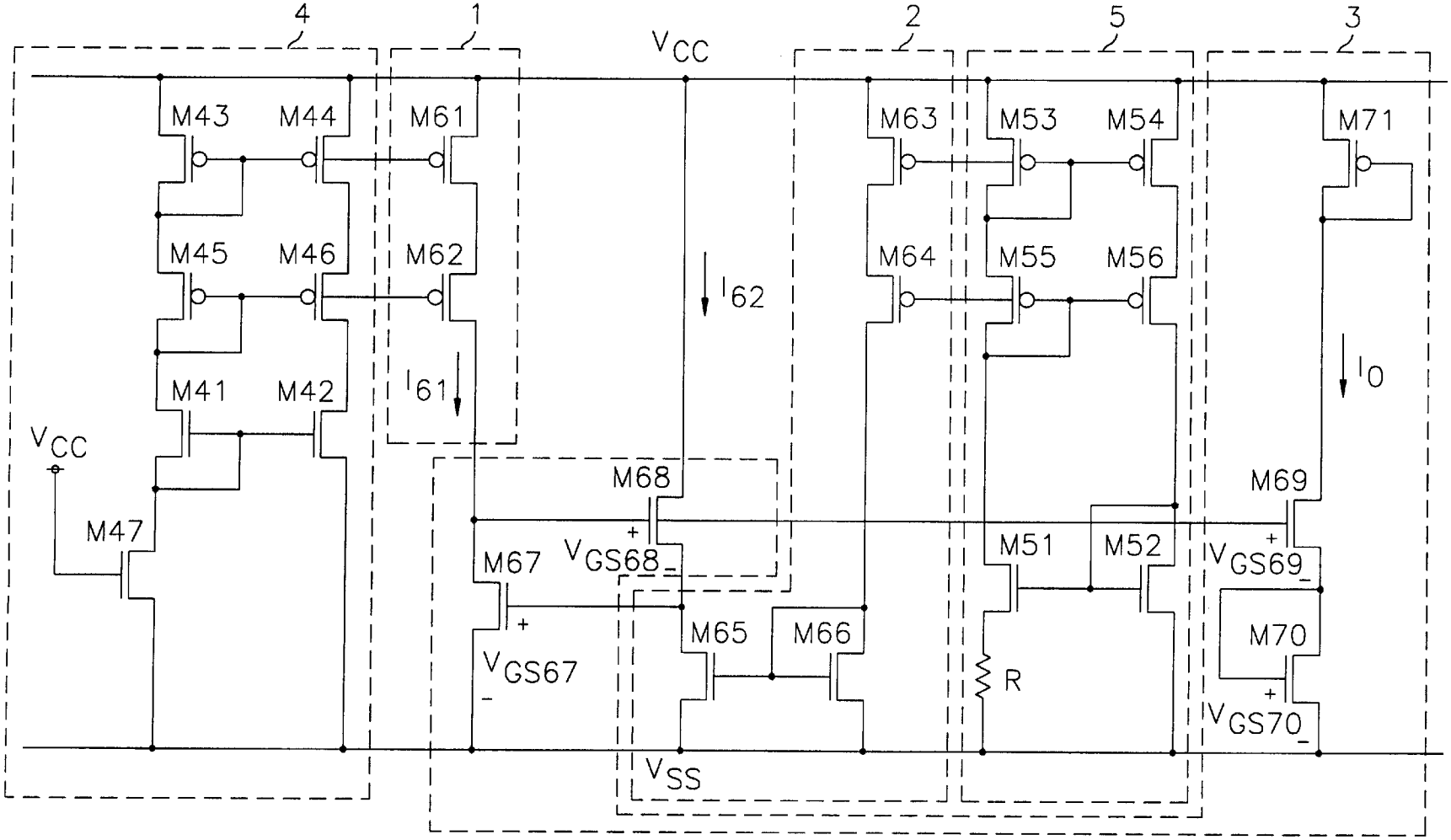
FIG. 6 depicts a circuit diagram of the constant current generator in accordance with the present invention.

Referring to FIG. 6, there is represented a temperature compensatory constant current generator in accordance with the present invention, wherein a temperature inversely proportional constant current generator 4 is the same one as shown in FIG. 4, and a temperature proportional constant current generator 5 is such as the one shown in FIG. 5.

A temperature inversely proportional current supplier 1 includes transistors M61 and M62 coupled to pairs of the transistors M43 and M44, M45 and M46, respectively, which form respective current mirror circuits of the temperature inversely proportional constant current generator 4, and thus, outputs a constant current I61 from the temperature inversely proportional constant generator 4, wherein the constant current I61 is inversely proportional to temperature change.

A temperature proportional current supplier 2 includes transistors M63 and M64 coupled to pairs of the transistors M53 and M54, M55 and M45, which form respective current mirror circuits of the constant current generator 5 and thus, outputs a constant current I62 from the temperature proportional constant current generator 5, wherein the constant current I62 is proportional to temperature change. The transistors M65 and 66 serves to operate as a scale and current mirror circuit for scaling and mirroring the current $I_{62}$.

The current suppliers 1 and 2 are connected to the squared roots generator 3, which includes a transistor M68 for which the current I61 is provided to the gate thereof and I62 to the source thereof; a transistor M67 for which the current I61 is provided to the source thereof and drain current from the transistor M65 to the gate thereof; a transistor M69 which is coupled to the transistor M68; a transistor M70 connected to the transistor M69; and a transistor M71 which serves to operate a bias resistor. All of the transistors M67, M68, M69 and M70 operate in weak inversion region and the output current Io is proportional to multiplied square roots of the currents I61 and I62.

Figure 7:
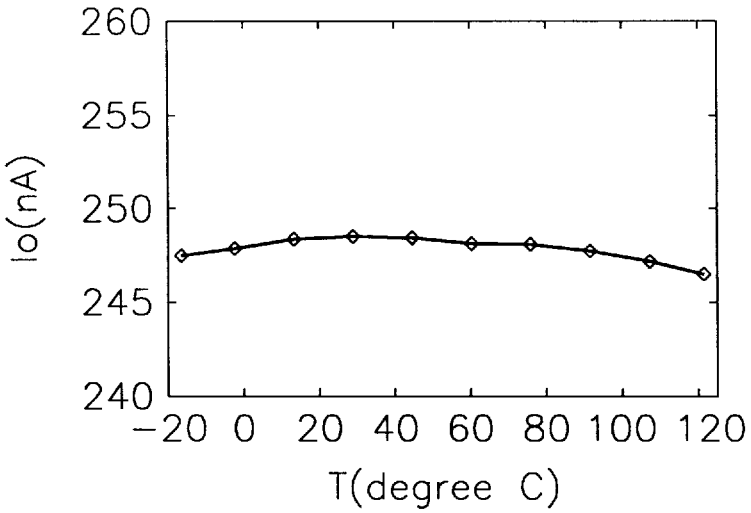
FIG. 7 illustrates a graph representing the output current level of the constant current generator as a function of the temperature.

In FIG. 7, a graph representing the current level Io as a function of the temperature is shown, wherein the average values of 10 samples are given. In temperature range of −15° to 125° C., the current changes is 24 ppm/° C. and in temperature range of 0° to 70° C., the current change is only 10 ppm/° C.

As described above, in accordance with the present invention, there is provided a constant current generator insensitive to temperature.

While the present invention has been described with respect to certain preferred embodiments only, other modifications and variations may be made without departing from the scope of the present invention as set forth in the following claims.

What is claimed is:

1. A temperature compensatory constant current generator comprising:

a temperature inversely proportional constant current generator for supplying a temperature inversely proportional current;

a temperature proportional constant current generator for supplying a temperature proportional current;

a temperature inversely proportional current supplier for outputting the temperature inversely proportional current from the temperature inversely proportional constant current generator;

a temperature proportional current supplier for outputting the temperature proportional current from the temperature proportional constant current generator; and a square root generator for providing a current proportional to multiplied square roots of the temperature inversely proportional current and the temperature proportional current.

2. The temperature compensatory constant current generator according to claim 1, wherein the temperature inversely proportional constant current generator includes:

a first set of transistors connected in a cascode fashion which form current mirror circuits in pair;

a second pair of transistors, being connected to a pair forming a current mirror circuit in the first set of transistors; and a third transistor connected to one of the second pair of transistors.

3. The temperature compensatory constant current generator according to claim 2, wherein the first set and the second pair of transistors operate in saturated regions.

4. The temperature compensatory constant current generator according to claim 3, wherein the third transistor operates in linear region.

5. The temperature compensatory constant current generator according to claim 2, wherein the temperature proportional constant current generator includes:

a fourth set of transistors connected in a cascode fashion which form current mirror circuits in pair;

a fifth pair of transistors connected to a pair of the fourth set of transistors forming a current mirror circuit; and a resistor connected to one of the fifth set of transistors.

6. The temperature compensatory constant current generator according to claim 5, wherein the fourth set and the fifth pair of transistors operate in saturated regions.

7. The temperature compensatory constant current generator according to claim 5, wherein the temperature inversely proportional current supplier includes a sixth set of transistors, each of the transistors being connected to a corresponding pair forming a mirror circuit in the first set of transistors, respectively.

8. The temperature compensatory constant current generator according to claim 7, wherein the temperature proportional current supplier includes:

a seventh set of transistors, each of the transistors being connected to a corresponding pair forming a mirror circuit in the fourth set of transistors, respectively; and an eighth pair of transistors connected to one of the seventh set of transistor, the pair forming a mirror circuit.

9. The temperature compensatory constant current generator according to claim 8, wherein the square root generator includes:

a ninth transistor for inputting the temperature inversely proportional current to its gate and the temperature proportional current to its source;

a tenth transistor for inputting the temperature inversely proportional current to its source and the drain current of the ninth transistor to its gate;

an eleventh transistor connected to the ninth transistor; and a twelfth transistor connected to the eleventh transistor.

10. The temperature compensatory constant current generator according to claim 9, wherein the ninth, the tenth, the eleventh and the twelfth transistors operate in weak inversely regions.

11. The temperature compensatory constant current generator according to claim 1, wherein the square root generator generates two current components for cancelling out the temperature inversely proportional component existing in the temperature inversely proportional current and the temperature proportional component contained in the temperature proportional current.

12. The temperature compensatory constant current generator according to claim 1, biases of the temperature inversely proportional constant current generator and the temperature proportional constant current generator are determined by using a positive feedback loop of current mirror circuits.

* * * * *